US006341436B2

(12) United States Patent
Grandpierre et al.

(10) Patent No.: US 6,341,436 B2
(45) Date of Patent: Jan. 29, 2002

(54) DRYER-IRONER WITH HEATED IRONING CYLINDER AND HEAT CARRYING FLUID

(75) Inventors: Cyril Marc Michel Grandpierre, Troyes; André Maziere, Saint Parres les Vaudes; Claude Dermy, St. Thibault, all of (FR)

(73) Assignee: Electrolux Systemes de Blanchisserie, Roseires-Pres-Troyes (FR)

( * ) Notice: Subject to any disclaimer, the term of this patent is extended or adjusted under 35 U.S.C. 154(b) by 0 days.

(21) Appl. No.: 09/792,156

(22) Filed: Feb. 22, 2001

(30) Foreign Application Priority Data

Feb. 23, 2000 (FR) ..... 00 02231

(51) Int. Cl.[7] ..... D06F 65/06
(52) U.S. Cl. ..... 38/44
(58) Field of Search ..... 38/44, 47, 16, 38/18, 66

(56) References Cited

U.S. PATENT DOCUMENTS 2,225,166 A * 12/1940 Erby ..... 38/44
2,362,947 A * 11/1944 Sullivan ..... 38/44 X
4,418,486 A * 12/1983 Kober ..... 38/44
4,677,773 A 7/1987 Kamberg
5,933,988 A * 8/1999 Adler ..... 38/66

FOREIGN PATENT DOCUMENTS

DE 186 629 7/1907
DE 1280802 * 10/1968 ..... 38/44

* cited by examiner

*Primary Examiner*—Ismael Izaguirre
(74) *Attorney, Agent, or Firm*—Pearne & Gordon LLP

(57) ABSTRACT

In a dryer-ironer, the cylinder (10) of which is heated from inside, the cylinder is built so as to define between two concentric walls (18, 22), a closed annular chamber (26) containing a heat carrying fluid. The fluid is set into motion through a stirring system integrated into the cylinder, so that establishment of a uniform temperature may be provided along its entire length. The stirring system may be passive (blades) or active (pump).

12 Claims, 3 Drawing Sheets

DRYER-IRONER WITH HEATED IRONING CYLINDER AND HEAT CARRYING FLUID

TECHNICAL FIELD

The invention relates to a dryer-ironer wherein laundry is ironed between a heated ironing cylinder and one or more endless straps which are in contact with the cylinder on a portion of its circumference.

The dryer-ironer according to the invention may be used in all cases where relatively large amounts of laundry must be ironed frequently. Thus and uniquely as an example, such a machine may be used in hospital institutions, nursing homes, hotels, lodging houses, restaurants, etc.

STATE OF THE ART

In dryers-ironers with a heated ironing cylinder, the pieces of laundry are inserted one after the other between a rotating cylinder, with a generally horizontal axis, and one or more endless straps which are in contact with the cylinder along its entire length and a portion of its circumference. Heating means placed inside the cylinder bring the latter's metal wall up to a determined temperature, selected in order to provide effective ironing of the laundry.

The heating means which are placed inside the ironing cylinder are of different types, depending on the machines. Hence, these heating means may comprise a gas manifold, heating resistances, infrared heating devices, etc.

In existing dryers-ironers, the ironing cylinder has a relatively thick cylindrical wall. This wall is generally made of steel. It has relatively large thermal inertia, because of its thickness.

In a dryer-ironer of this type, the passing of a piece of laundry with a given width between the ironing cylinder and the endless straps has the effect of lowering the temperature of the cylinder in the concerned area. On the contrary, the areas of the cylinder not concerned by the passing of the piece of laundry and which continue to be heated, experience a rise in their temperature. Considering the relatively large thermal inertia of the ironing cylinder, a piece of laundry immediately ironed after the previous one will therefore encounter either an insufficiently heated area of the cylinder or on the contrary an overheated area of the cylinder, depending on whether it is inserted at the same place than the previous piece of laundry or at a different place. In the first case, the second piece of laundry is badly ironed. On the contrary, in the second case, the piece of laundry may be burnt. Actually, the thermal gradient even increases if several pieces of laundry are successively inserted substantially in the same area.

Dryers-ironers with a heated ironing cylinder are also known, wherein heating of the cylinder is provided by a heat carrying fluid such as oil. In this case, the heat carrying fluid is heated in a boiler located outside the machine, before being fed into the cylinder by a pump also placed outside the machine.

Such a machine does not have the drawbacks of dryers-ironers for which the ironing cylinder is heated by heating means integrated into this cylinder. Actually, permanent circulation of the heat carrying fluid is able to provide efficient diffusion of the heat over the entire length of the cylinder and consequently, to impart to the latter, a substantially uniform temperature over its entire length even after the passing of a piece of laundry in the machine.

On the other hand, the dryers-ironers of this type have the drawbacks of requiring heavy, external, expensive and complex facilities.

This drawback sometimes causes the users to simultaneously feed several machines by a unique circuit integrating one single boiler and one single pump. However, the cost of such a facility remains substantially greater than that of a dryer-ironer for which the ironing cylinder is heated by an integrated heating system.

DESCRIPTION OF THE INVENTION

Specifically, the object of the invention is a dryer-ironer with a heated ironing cylinder, having both the advantages of simplicity of machines with integrated heating in the cylinder and the advantages of uniform diffusion of heat over the entire length of the cylinder of machines for which the cylinder is heated by a heat carrying fluid.

According to the invention, this result is obtained by means of a dryer-ironer comprising an ironing cylinder provided with a cylindrical wall and able to rotate about an axis of said wall, and heating means placed inside the cylinder, in order to heat the cylindrical wall, characterized in that the cylinder further comprises an external wall, encircling the cylindrical wall in order to delimit with the latter an closed annular chamber, filled with a heat carrying fluid, and stirring means able to generate a circulation of the heat carrying fluid within said chamber, wherein said stirring means comprise units placed in the annular chamber.

In this machine, the ironing cylinder is heated from the inside by traditional heating means, which may be of any type, as in the existing machines for which the cylinder is heated from the inside. Moreover, by using an ironing cylinder with a double wall, by filling the closed annular chamber thus defined by a heat carrying fluid and by using means for stirring this fluid, integrated into the cylinder, an efficient diffusion of heat on the entire length of the cylinder may be provided without substantially increasing the complexity and the cost of the machine.

According to a first embodiment of the invention, the aforementioned units are passive units, placed in the annular chamber in order to generate circulation of the heat carrying fluid when the cylinder is rotating around its axis.

These passive units comprise, for example, blades supported by the cylindrical wall, wherein these blades are inclined with respect to the cylinder's axis, so as to generate motion of the heat carrying fluid, parallel to the axis of the cylinder, upon the latter's rotation.

Preferably, the blades have a height substantially equal to the thickness of the annular chamber, in order to also serve as support for the external wall of the cylinder.

In the first embodiment of the invention, the heat carrying fluid is a liquid which only fills a portion of the annular chamber. This liquid is topped by a neutral gas, so that the annular chamber also acts as an expansion vessel.

Advantageously, stabilizers such as balls are then placed in the liquid in order to oppose a rotation of the latter with the cylinder when the latter rotates around its axis.

According to a second embodiment of the invention, the aforementioned units are partitions in a staggered configuration within the annular chamber, in order to delimit between the cylindrical wall and the external wall of the cylinder, a path for reciprocating motion, substantially parallel to the axis of the cylinder. Now, the stirring means further comprise driving means such as a pump in order to cause circulation of the heat carrying fluid along this path.

In both embodiments of the invention, the external wall preferably has a thickness lower than that of the cylindrical wall.

Moreover, the external wall of the cylinder is advantageously made of stainless steel and the cylindrical wall of ordinary steel.

Preferably, at least one end of the external wall is encircled by a discharge space, externally delimited by a fixed case. A valve is then mounted in the aforementioned end of the external wall so as to allow the annular chamber to communicate with the discharge space, in the event of overpressure in said chamber.

Advantageously, a duct connects the discharge space to a tank, in order to provide flow by gravity of the heat carrying fluid.

BRIEF DESCRIPTION OF DRAWINGS

Different embodiments of the invention will now be described as non-limiting examples with reference to the appended drawings, wherein.

DETAILED DESCRIPTION OF PREFERRED EMBODIMENTS

Figure 1:
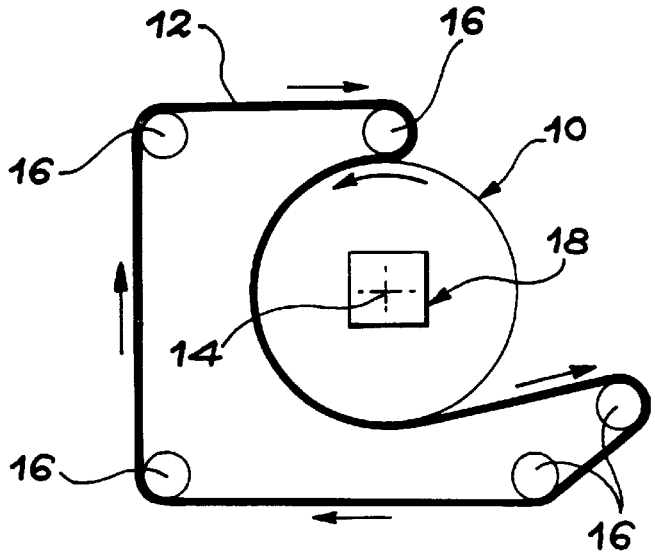
FIG. 1 is a sectional view which very schematically illustrates a dryer-ironer according to the invention.

As illustrated in FIG. 1 very schematically, the dryer-ironer according to the invention comprises an ironing cylinder 10 as well as one or more endless straps 12 which are in contact with cylinder 10 on its entire length and on the greater part of its periphery. This type of machine is well known to one skilled in the art, so that only the characteristics required for a good understanding of the invention will be described.

The ironing cylinder 10 is supported by a fixed frame (not shown) so that it may rotate freely around a substantially horizontal axis 14.

The endless straps 12 are supported and guided by rollers 16 borne by the chassis of the machine. The axes of rotation of the rollers 16 are parallel to the axis 14 of the ironing cylinder 10. Any of the rollers 16 may be driven into rotation by a geared motor (not shown) in order to be able to provide motion of the endless straps 12 in the direction of the arrows in FIG. 1. This motion has the consequence of causing the ironing cylinder 10 to rotate in the same direction and at the same speed.

As schematically illustrated at 18 in FIG. 1, the ironing cylinder 10 is internally equipped with heating means of any known type, able to bring the cylinder to a selected temperature in order to provide efficient ironing of the laundry. These heating means 18 may be any heating means such as electric resistances, a gas manifold, an infrared heating device, etc. without departing from the scope of the invention.

In order to provide ironing, the pieces of laundry are inserted, one after the other, between the ironing cylinder 10 and the endless straps 12, in the higher portion of the machine. They are then fed between the cylinder and the endless straps so that they come out in the lower portion of the machine.

According to the invention, the ironing cylinder 10 has an original structure which will now be described with reference to FIG. 2.

As illustrated in this figure, the ironing cylinder 10 comprises a cylindrical wall 20, centered on axis 14 and made of a metal such as ordinary steel. The thickness of the cylindrical wall 20 is selected in order to provide the cylinder with good mechanical strength, without virtually any deformation, during the ironing. For example, this thickness varies between 4 mm and 6 mm according to the size of the cylinder. As schematically illustrated, heating means 18 are placed inside the cylindrical wall 20.

The cylindrical wall 20 is externally lined, over virtually its entire length, by a cylindrical external wall 22, also centered on axis 14. The external wall 22 is made of stainless steel and it has a thickness substantially lower than that of the cylindrical wall 20. More specifically, the thickness of the cylindrical wall 20 is at least twice that of the external wall 22, whereby the latter may vary for example, between 1.5 mm and 2 mm depending on the size of the ironing cylinder.

The external wall 22 is mounted concentrically and at a distance from the cylindrical wall 20, for example by means of two welded rings 24 close to the ends of the cylindrical wall 20 and on which are welded the ends of external wall 22.

A closed annular chamber 26 with uniform thickness, which is at least partially filled with a heat carrying fluid, is thus delimited between the cylindrical wall 20 and the external wall 22.

As described in detail later on, the ironing cylinder 10 is also equipped with integrated stirring means, designed for providing circulation of the heat carrying fluid contained in the closed annular chamber 26, when the ironing cylinder 10 rotates around its axis 14. More specifically, the stirring means have the function of causing the heat carrying fluid to circulate both in parallel to axis 14 of the cylinder, in order to homogenize the temperature, and between walls 20 and 22, in order to transfer heat released by the heating means 18 to the external wall 22.

Figure 2:
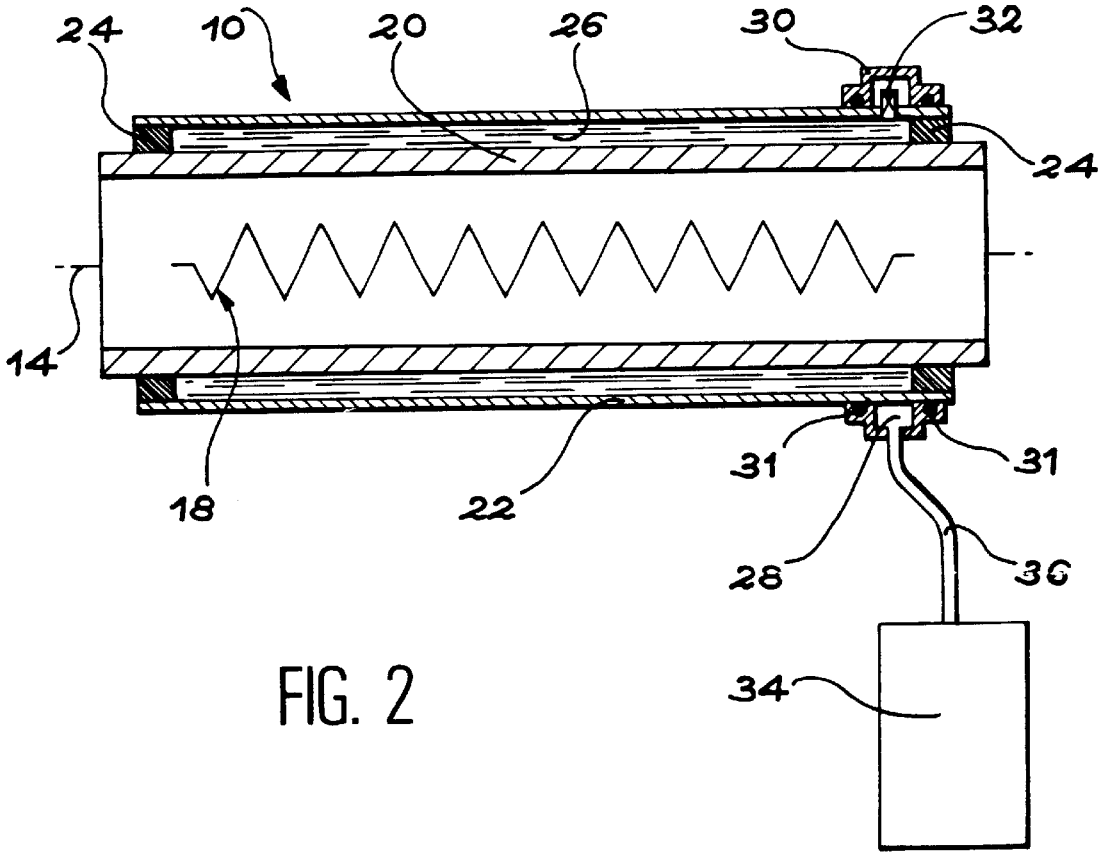
FIG. 2 is a partial longitudinal sectional view schematically illustrating the ironing cylinder of the machine of FIG. 1 and its associated components.

As also schematically illustrated in FIG. 2, at least one of the ends of the external wall 22 of the ironing cylinder 10 is encircled by a discharge space 28, delimited inwardly by said external wall 22 and outwardly and laterally, by a fixed case 30. Sealing units such as revolving joints 31 borne by fixed case 30 ensure water tightness of the discharge space 28.

A valve 32, mounted on the end of the external wall 22 encircled by the discharge space 28, enables the annular chamber to be connected with said discharge space, notably when the pressure within the chamber 26 exceeds a predetermined threshold.

The bottom of the discharge space 28 communicates with a tank 34 through a duct 36. This duct 36 is laid out in order to enable the heat carrying fluid collected in the discharge space 28 to flow by gravity into tank 34.

Figure 3:
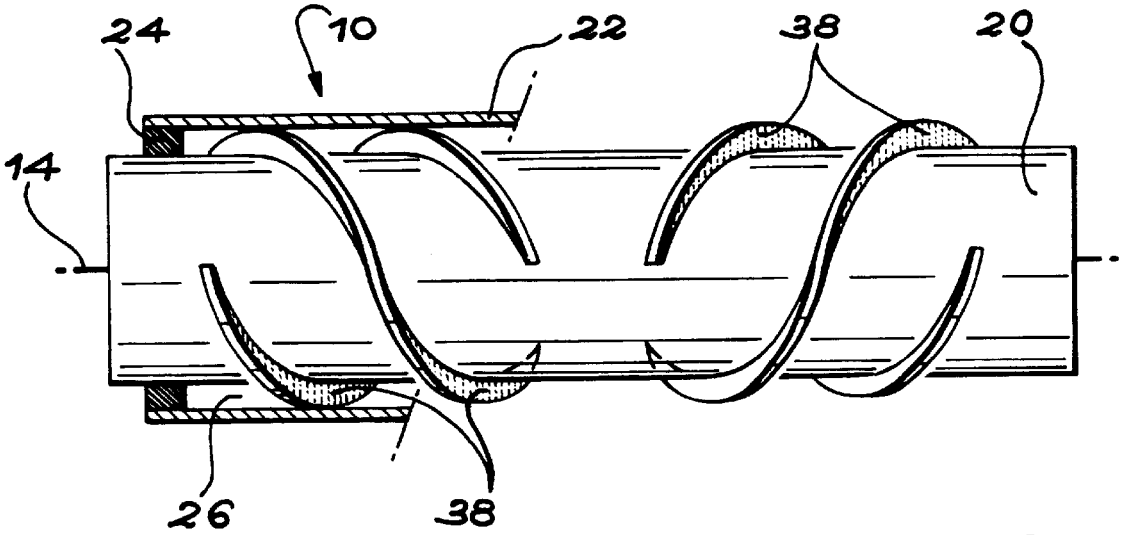
FIG. 3 is a partial sectional view comparable to FIG. 2, illustrating a first embodiment of the invention, wherein the ironing cylinder is provided with stirring means of the passive type.
Figure 4:
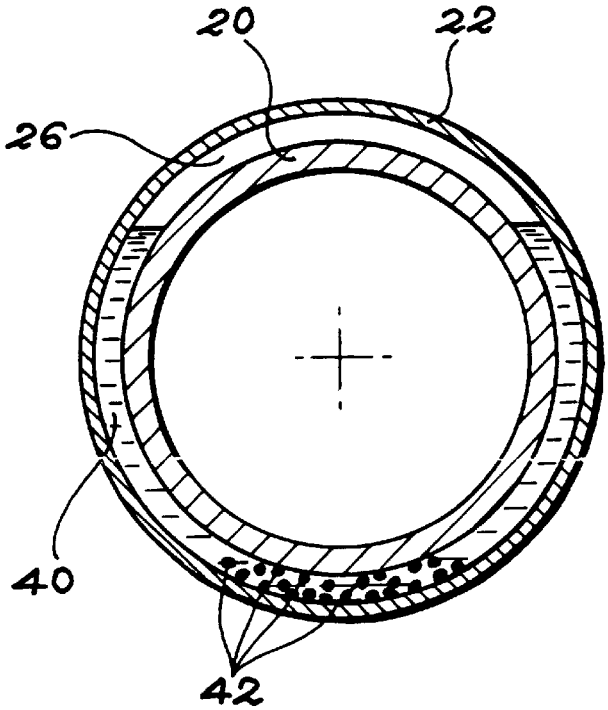
FIG. 4 is a sectional view of the ironing cylinder illustrated if FIG. 3.

According to a first embodiment of the invention, and as illustrated in FIGS. 3 and 4, the stirring means for the heat carrying fluid inside the annular chamber 26 may notably be of the passive type.

In this case, the stirring means comprise passive units such as blades 38 placed in the annular chamber 26, in order to generate the desired circulation of heat carrying fluid when the cylinder rotates around its axis 14. More specifically, the blades 38 are positioned in order to bring the heat carrying fluid from the ends of the annular chamber 26, back into a central region of the latter. For this purpose, if the cylinder is considered to be formed of two abutting sections, the blades 38 may notably assume the shape of spirals wound in one direction on a first of these sections and wound in the other direction on the other section, whereby the direction of the spirals is such that the heat carrying fluid is brought back from the ends towards the center when the ironing cylinder 10 is rotating about its axis 14.

In practice, the blades 38 are fixed on the cylindrical wall 20, for example by welding, and they have a height substantially equal to the thickness of the annular chamber 26, for example this thickness is of about 5 mm. Thus the blades 38 also serve as a support for the external wall 22, which usually has relatively reduced thickness, as seen earlier, with respect to that of the cylindrical wall 20 of cylinder 10.

With this layout, a satisfactory geometrical shape may be maintained for the external wall 22, which is directly used for ironing the laundry when the machine is in operation.

It is to be noted that passive units, materialized by blades 38 in FIG. 3, may assume substantially different shapes, without departing from the scope of the invention. Thus, the spiral blades 38 may be replaced with substantially planar blade sections in order to reduce the manufacturing costs for the machine.

The heat carrying fluid contained in annular chamber 26 usually consists of a liquid such as oil capable of providing efficient heat transfer between cylindrical wall 20 and external wall 22, under conditions of temperature for ironing. Such heat carrying liquids are well known to one skilled in the art and will therefore not be described.

In the first embodiment of the invention, and as illustrated in FIG. 4 in particular, the heat carrying liquid 40 only partially fills the annular chamber 26. In this case, the upper portion of the annular chamber 26 is filled with a neutral gas. Chamber 26 then acts as an expansion vessel.

It is desirable to prevent the heat carrying fluid 40 from being driven into rotation by blades 38 and walls 20 and 22 of the cylinder 10 during rotation of the latter. Actually, this would reduce the stirring of the liquid and consequently the achievement of a substantially uniform temperature over the entire length of the external wall 22 of the cylinder. For this purpose, the placement of stabilizers such as balls 42 within liquid 40 proves to be advantageous.

Figure 5:
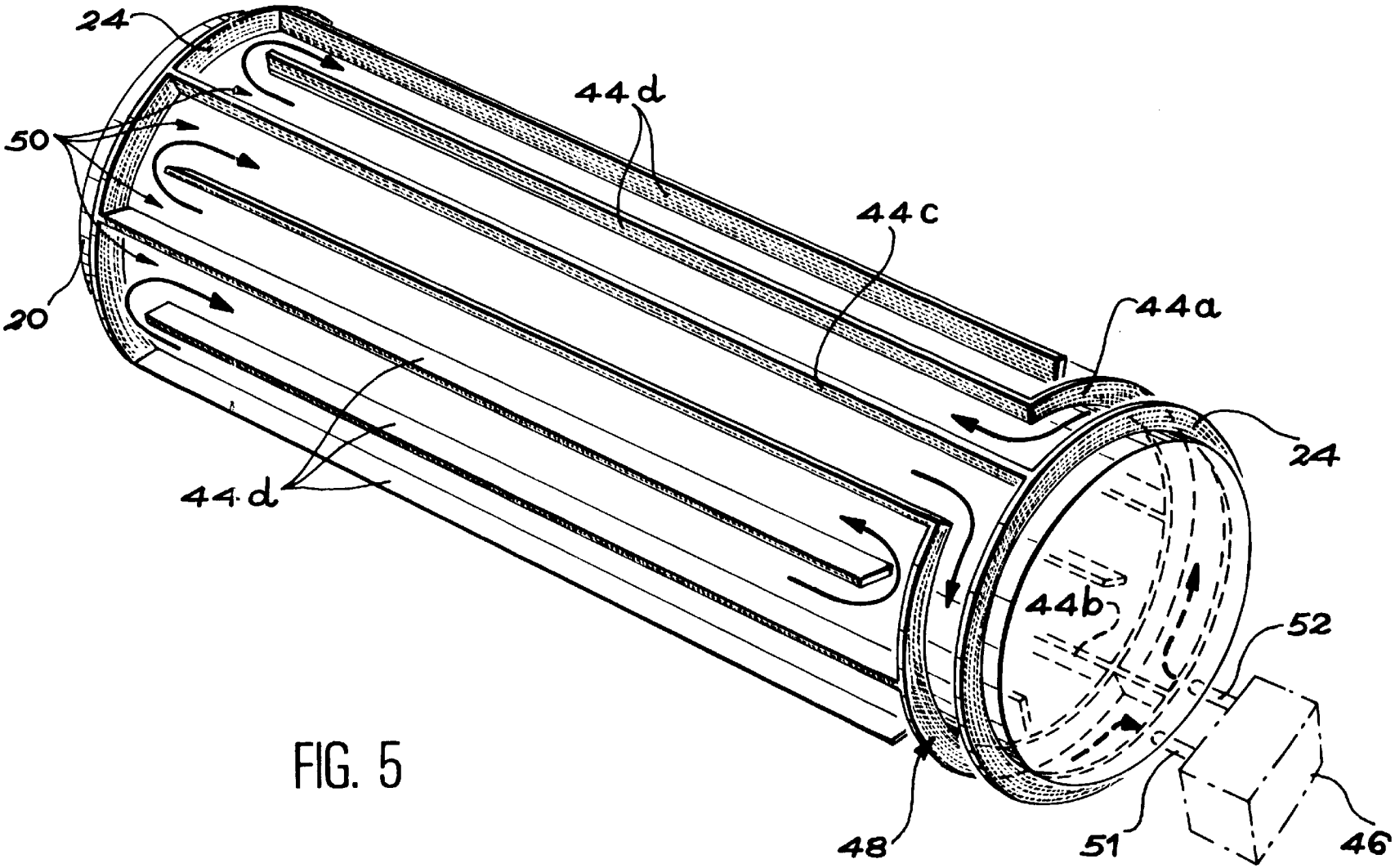
FIG. 5 is a perspective view, illustrating a second embodiment of the invention, wherein the ironing cylinder is provided with stirring means of the active type, wherein the external wall of the cylinder has deliberately been omitted in order to facilitate the understanding.

In a second embodiment of the invention, illustrated in FIG. 5, active stirring means are used for moving the heat carrying fluid in the annular chamber 26 provided between the cylindrical wall 20 and the external wall 22 of the cylinder. These active stirring means enable the heat carrying fluid to be moved regardless of the rotation of the cylinder.

The active stirring means now comprise partitions 44*a,* 44*b,* 44*c* in a staggered configuration inside the annular chamber 26, so as to delimit between the cylindrical wall 20 and the external wall 22 of cylinder 10, a path for reciprocating motion, substantially in a parallel orientation with respect to the axis 14 of the cylinder. The active stirring means also comprise driving means, such as a pump 46, mounted on the cylinder in order to cause the heat carrying fluid to circulate along the path delimited by partitions 44*a,* 44*b,* 44*c*.

More specifically, partitions 44*a,* 44*b,* 44*c* delimiting the aforementioned path are fixed on the cylindrical wall 20 and extend over a height substantially equal to the thickness of the annular chamber 26, so that they also serve as a support for the external wall 22, like the blades 38 in the first embodiment of the invention.

As illustrated more specifically in FIG. 5, the aforementioned partitions comprise a circumferential partition 44*a,* closely placed to one of the rings 24, in order to delimit with the latter, an annular channel 48. Two rectilinear partitions 44*b,* 44*c* parallel to axis 14 of the cylinder and located in diametrically opposite positions, extend over the entire length of the cylinder between both rings 24. Finally, a certain number of rectilinear partitions 44*d,* also parallel to axis 14, are regularly distributed over the entire circumference of the cylinder, between the circumferential partition 44*a* and ring 24 which is the furthest away from this partition, on both sides of the rectilinear partitions 44*b* and 44*c*. The rectilinear partitions 44*b,* 44*c* and 44*d* thereby delimit axial channels 50 between each other.

In addition, the circumferential partition 44*a* is interrupted between both rectilinear partitions 44*d* which are the closest to rectilinear partition 44*c,* so that the axial channels 50 adjacent to the latter, are in communication with the annular channel 48.

Moreover, one out of two of the rectilinear partitions 44*d* is in turn, interrupted close to ring 24, the furthest away from the circumferential partition 44*a* and close to said circumferential partition. Rectilinear partition 44*b* is also interrupted close to ring 24, the furthest away from the circumferential partition 44*a*. More specifically, the layout is such that both rectilinear partitions 44*d,* the closest to rectilinear partition 44*b,* are interrupted close to the circumferential partition 44*a,* and both rectilinear partitions 44*d,* the closest to rectilinear partition 44*c,* are interrupted close to ring 24 the furthest away from the circumferential partition 44*a*. The adjacent axial channels 50 thus communicate with each other at one end and at the other end of the cylinder, alternately. In this way, a path for reciprocating motion is delimited for the heat carrying fluid, parallel to the axis of cylinder 10.

Pump 46 is borne by cylinder 10 and connected to the annular channel 48, on both sides of the rectilinear partition 44*b,* through suction 51 and discharge 52 ducts.

With the layout which has just been described, circulation of the cooling fluid may be established along the path delimited by the various partitions 44, as indicated by the arrows in FIG. 5. A reciprocating movement of the fluid is thus established, parallel to axis 14 of cylinder 10, over the entire periphery of the latter.

In both described embodiments, the dryer-ironer has a relatively simple and not very expensive structure. In particular, it should be noted that the cylindrical wall 20, which is not in contact with the laundry to be ironed, may be made of ordinary steel. Therefore, the amount of stainless steel may be reduced as compared with an existing machine, because the external wall 22 has a lesser thickness.

Moreover and essentially, with the presence of the heat carrying fluid between both walls of the cylinder and by causing this heat carrying fluid to circulate through passive or active stirring means which equip the cylinder, the temperature of the external wall 22 in contact with the laundry may be made equal during the whole ironing period. The quality of ironing is thus improved very substantially as compared to dryers-ironers existing today with an ironing cylinder heated from the inside.

Of course, the machine may undergo many alterations, without departing from the scope of the invention. In particular, the stirring means for setting the heat carrying fluid into motion between both walls of the cylinder may assume shapes different from those which have been described.

What is claimed is:

1. A dryer-ironer comprising an ironing cylinder provided with a cylindrical wall and able to rotate around an axis of said wall, and heating means placed inside the cylinder, for heating the cylindrical wall, wherein the cylinder further comprises an external wall, encircling the cylindrical wall in order to delimit with the latter a closed annular chamber, filled with a heat carrying fluid, and stirring means able to generate circulation of the heat carrying fluid inside said chamber, said stirring means comprising units placed in the annular chamber, wherein the external wall has a smaller thickness than the one of the cylindrical wall.

2. A dryer-ironer according to claim 1, wherein said units are passive units placed in the annular chamber so as to generate circulation of the heat carrying fluid when the cylinder rotates about its axis.

3. A dryer-ironer according to claim 2, wherein said passive units comprise blades borne by the cylindrical wall, wherein said blades are inclined with respect to the axis of the cylinder.

4. A dryer-ironer according to claim 3, wherein the blades have a height substantially equal to the thickness of the annular chamber, so as to serve as a support for the external wall.

5. A dryer-ironer comprising an ironing cylinder provided with a cylindrical wall and able to rotate around an axis of said wall, and heating means placed inside the cylinder, for heating the cylindrical wall, wherein the cylinder further comprises an external wall, encircling the cylindrical wall in order to delimit with the latter a closed annular chamber, filled with a heat carrying fluid, and stirring means able to generate circulation of the heat carrying fluid inside said chamber, said stirring means comprising units placed in the annular chamber, wherein said units are passive units placed in the annular chamber so as to generate circulation of the heat carrying fluid when the cylinder rotates about its axis, wherein the heat carrying fluid is a fluid which only fills a portion of the annular chamber, wherein said liquid is topped with a neutral gas.

6. A dryer-ironer according to claim 5, wherein stabilizers are placed in the liquid in order to oppose rotation of the latter when the cylinder rotates about its axis.

7. A dryer-ironer comprising an ironing cylinder provided with a cylindrical wall and able to rotate around an axis of said wall, and heating means placed inside the cylinder, for heating the cylindrical wall, wherein the cylinder further comprises an external wall, encircling the cylindrical wall in order to delimit with the latter a closed annular chamber, filled with a heat carrying fluid, and stirring means able to generate circulation of the heat carrying fluid inside said chamber, said stirring means comprising units placed in the annular chamber, wherein said units are partitions in a staggered configuration within the annular chamber, in order to delimit between the cylindrical wall and the external wall, a path for reciprocating motion, substantially parallel to the axis of the cylinder, wherein the stirring means further comprise driving means for causing the heat carrying fluid to circulate along said path.

8. A dryer-ironer according to claim 7, wherein the partitions have a height substantially equal to the thickness of the annular chamber, so as to serve as a support for the external wall.

9. A dryer-ironer comprising an ironing cylinder provided with a cylindrical wall and able to rotate around an axis of said wall, and heating means placed inside the cylinder, for heating the cylindrical wall, wherein the cylinder further comprises an external wall, encircling the cylindrical wall in order to delimit with the latter a closed annular chamber, filled with a heat carrying fluid, and stirring means able to generate circulation of the heat carrying fluid inside said chamber, said stirring means comprising units placed in the annular chamber, wherein the external wall is made out of stainless steel and the cylindrical wall out of ordinary steel.

10. A dryer-ironer according to claim 9, wherein said units are passive units placed in the annular chamber so as to generate circulation of the heat carrying fluid when the cylinder rotates about its axis.

11. A dryer-ironer comprising an ironing cylinder provided with a cylindrical wall and able to rotate around an axis of said wall, and heating means placed inside the cylinder, for heating the cylindrical wall, wherein the cylinder further comprises an external wall, encircling the cylindrical wall in order to delimit with the latter a closed annular chamber, filled with a heat carrying fluid, and stirring means able to generate circulation of the heat carrying fluid inside said chamber, said stirring means comprising units placed in the annular chamber, wherein at least an end of the external wall is encircled by a discharge space externally delimited by a fixed case, wherein a valve is mounted in said end of the external wall in order to enable the annular chamber to be in communication with the discharge space, in the event of an overpressure in said chamber.

12. A dryer-ironer according to claim 11, wherein a duct with gravity flow connects the discharge space to a tank.

* * * * *